US006698605B2

(12) United States Patent
Clodfelter et al.

(10) Patent No.: US 6,698,605 B2
(45) Date of Patent: Mar. 2, 2004

(54) MODIFIED BOTTLE NECK FOR USE WITH CHILD RESISTANT CAPS

(75) Inventors: Christopher B. Clodfelter, Evansville, IN (US); Todd E. Mathes, Newburgh, IN (US); William Douglas Sprick, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 0 days.

(21) Appl. No.: 09/861,959

(22) Filed: May 21, 2001

(65) Prior Publication Data

US 2002/0170873 A1 Nov. 21, 2002

(51) Int. Cl.[7] ..... B65D 55/02
(52) U.S. Cl. ..... 215/216; 215/217; 215/221
(58) Field of Search ..... 222/520, 521, 222/153.14; 215/14–18, 40, 44, 43, 218, 219, 201, 315, 314, 519, 202, 209, 217, 216

(56) References Cited

U.S. PATENT DOCUMENTS

| | | | | | |
|---|---|---|---|---|---|
| 3,303,428 | A | * | 2/1967 | Baarn | 215/221 |
| 3,826,395 | A | * | 7/1974 | Montgomery | 215/221 |
| 3,917,097 | A | * | 11/1975 | Uhlig | 215/216 |
| 3,941,268 | A | * | 3/1976 | Owens et al. | 215/216 |
| 4,117,945 | A | * | 10/1978 | Mumford | 215/216 |
| 4,314,656 | A | | 2/1982 | Kessler | |
| 4,351,442 | A | * | 9/1982 | Summers | 215/216 |
| 4,351,443 | A | * | 9/1982 | Uhlig | 215/216 |
| 4,358,031 | A | | 11/1982 | Lohrman | |
| 4,376,497 | A | * | 3/1983 | Mumford | 215/216 X |
| 4,540,098 | A | * | 9/1985 | Luker | 215/216 |
| 4,567,991 | A | * | 2/1986 | Anderson | 215/216 |
| 4,646,949 | A | | 3/1987 | Stull | |
| 4,667,836 | A | * | 5/1987 | McLaren | 215/216 |
| 4,705,181 | A | | 11/1987 | Burke et al. | |
| 4,749,103 | A | | 6/1988 | Barriac | |
| 4,927,065 | A | | 5/1990 | Beck | |
| 4,979,648 | A | | 12/1990 | Montgomery et al. | |
| 5,044,530 | A | | 9/1991 | Stull | |
| 5,111,949 | A | | 5/1992 | Ambrosi et al. | |
| 5,141,129 | A | | 8/1992 | Jennings | |
| 5,186,369 | A | | 2/1993 | Aguirrezabal | |
| 5,413,233 | A | * | 5/1995 | Hall | 215/221 X |
| 5,507,416 | A | | 4/1996 | Rapchak et al. | |
| 5,638,969 | A | * | 6/1997 | King | 215/216 |
| 5,735,417 | A | * | 4/1998 | Darr et al. | 215/216 |
| 5,749,496 | A | | 5/1998 | DeJonge, Sr. et al. | |
| 5,779,072 | A | | 7/1998 | Krebs | |
| 5,836,466 | A | * | 11/1998 | Briere et al. | 215/216 |
| 5,850,951 | A | | 12/1998 | Hayes | |
| 5,899,368 | A | | 5/1999 | Joulia | |
| 5,908,125 | A | * | 6/1999 | Opresco | 215/216 |
| 5,947,345 | A | | 9/1999 | Hofmann | |
| 6,105,801 | A | * | 8/2000 | Minnette | 215/216 X |

FOREIGN PATENT DOCUMENTS

| | | |
|---|---|---|
| EP | 0 558 273 A1 | 2/1993 |

* cited by examiner

*Primary Examiner*—Tri M. Mai
(74) *Attorney, Agent, or Firm*—James E. Cole; John F. Salazar; Middleton Reutlinger

(57) ABSTRACT

A bottle having a modified neck and intended for use with a child-resistant closure which allows the user to open the bottle without removing the closure completely from the bottle is described. The neck includes at least one locking lug and at least one anti-removal ring. The anti-removal ring is positioned between the lug and the open end of the neck. The neck may further include at least one deformation recess, with the deformation recess being adjacent to and radially offset from the locking lug. The ring and recess are intended to deter the user from bypassing the child-resistant safety features of the bottle and removing the closure completely from the bottle.

13 Claims, 5 Drawing Sheets

MODIFIED BOTTLE NECK FOR USE WITH CHILD RESISTANT CAPS

BACKGROUND

The present invention relates to a bottle and child-resistant closure combination wherein the closure can be opened without being completely removed from the bottle. More particularly, the present invention relates to a modified bottle neck which includes an anti-removal ring to deter the user from completely removing the closure from the bottle.

Highly corrosive products, such as drain openers and antifreeze, are commonly packaged in bottles having child-resistant closures. The closures and their complementary bottles are designed to allow the user to open the bottle without completely removing the closure. For example, the user may squeeze the sides of the closure to release one or more locking lugs on the closure from corresponding locking lugs on the bottle neck, and then twist the closure enough to open an aperture in the closure allowing product to flow out of the bottle at a relatively controlled rate. Typically, the locking lugs on the closure and on the bottle neck are sufficiently long that the lugs interact at least a second time as the closure is twisted open thereby preventing the user from rotating the closure any further without an additional unlocking action.

However, the user can remove the closure completely by squeezing the sides of the closure and releasing the locking lugs as many times as necessary to allow the closure locking lugs to not engage the bottle locking lugs. Once the closure is removed, the risk of spilling large quantities of the product increases because the bottle has a relatively large neck opening as compared to the opening in the closure. Thus, it would be beneficial to have a bottle with a child-resistant closure that could not be easily removed from the bottle merely by squeezing the sides of the closure to release the closure locking lugs from the bottle locking lugs.

SUMMARY

The present invention relates to a bottle having a modified neck adapted for use with a child-resistant closure which allows the user to open the bottle without removing the closure completely from the bottle. The bottle neck includes at least one anti-removal ring which is intended to deter the user from bypassing the child-resistant safety features of the bottle and removing the closure completely from the bottle. The bottle neck may also include at least one deformation recess which allows the user to deform the closure to a greater extend than could be achieved without the recess thereby allowing the user to more easily disengage the locking lugs on the closure from the locking lugs on the bottle to open the bottle.

DETAILED DESCRIPTION

The present invention relates to a bottle having a modified neck and intended for use with a child-resistant closure. The modified neck depicted in the various Figures is selected solely for the purpose of illustrating the invention. Other and different necks may utilize the inventive features described herein as well.

Figure 5:
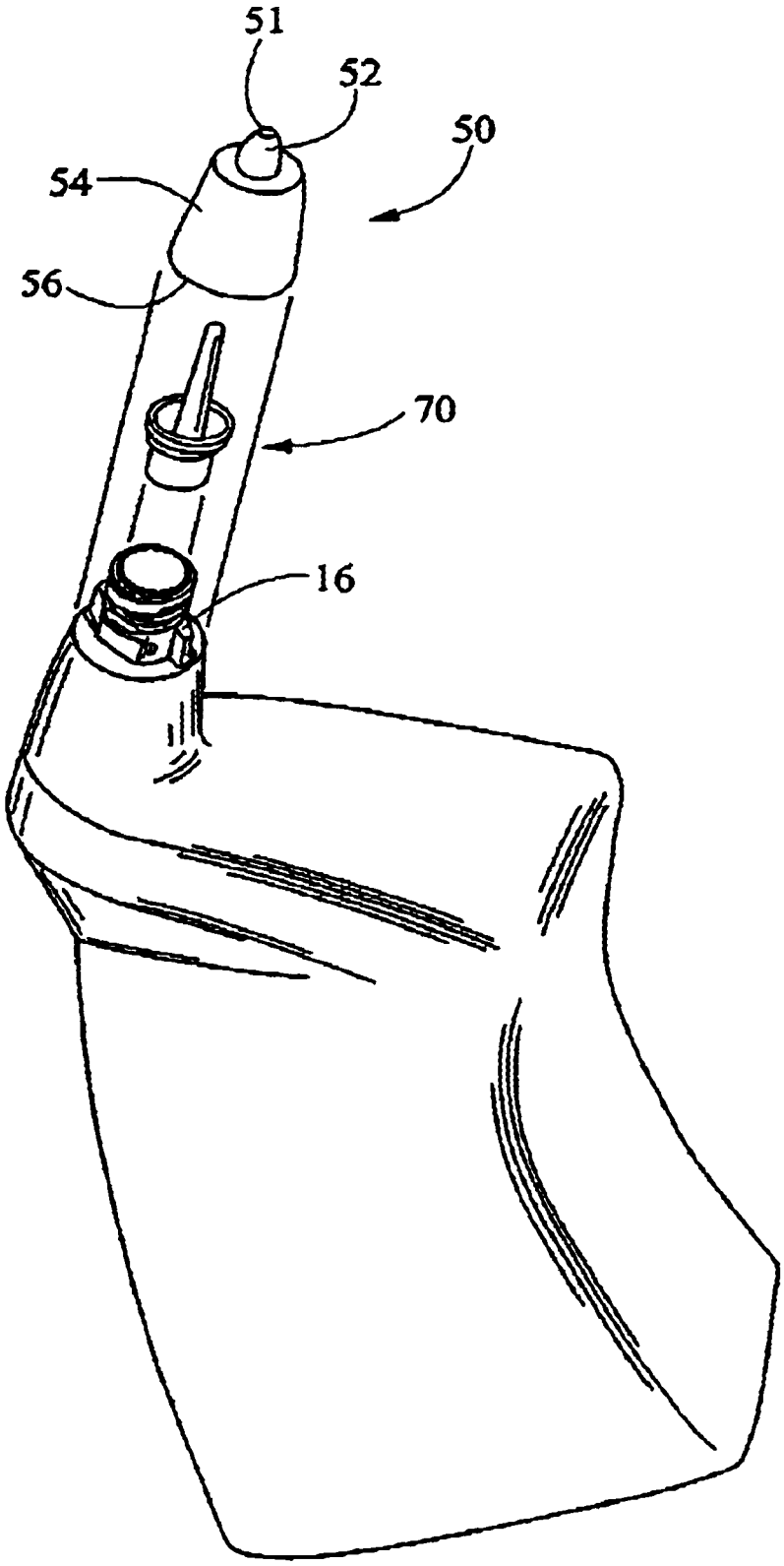
FIG. 5 is a perspective view of a closure which may be used with a bottle having a neck made in accordance with the present invention.

The bottle of the present invention is intended to be used with a child-resistant closure which allows the user to open the bottle without removing the closure completely from the bottle, such as the closure 50 shown in FIG. 5. The closure 50 is representative of the general type of closure which may be used with a bottle having a neck made in accordance with the present invention and is not intended to limit the scope of the invention. The closure 50 has a cap top 52 with an aperture 51, a cap skirt 54 extending from the cap top 52 to a cap bottom 56, at least one cap thread (not shown) located on an interior surface or engaging face of the cap skirt 54, and at least a first cap lug (not shown) located near the cap bottom 56. The thread and locking lug are fixedly attached to the engaging face of the cap skirt 54, as is known in the art. The closure 50 may be used with a separate plug 70 to control the product flow rate. In the "closed" position, the plug 70 projects through the closure aperture 51 so that product cannot flow out of the bottle and the closure locking lug engages a bottle locking lug 16 to prevent the closure 50 from unintentionally rotating to an "open" position. In the "open" position, the closure 50 is axially displaced from the plug 70 so that a gap or opening exists allowing product to flow out of the bottle. The user "opens" the bottle by squeezing the closure skirt 54 to deform the skirt 54 and to disengage the closure locking lug from the bottle locking lug 16 and then rotating the closure 50 counterclockwise. By rotating the closure 50 clockwise until closure and bottle locking lugs engage and the plug 70 protects through the aperture 51, the bottle can be "closed".

Figure 1:
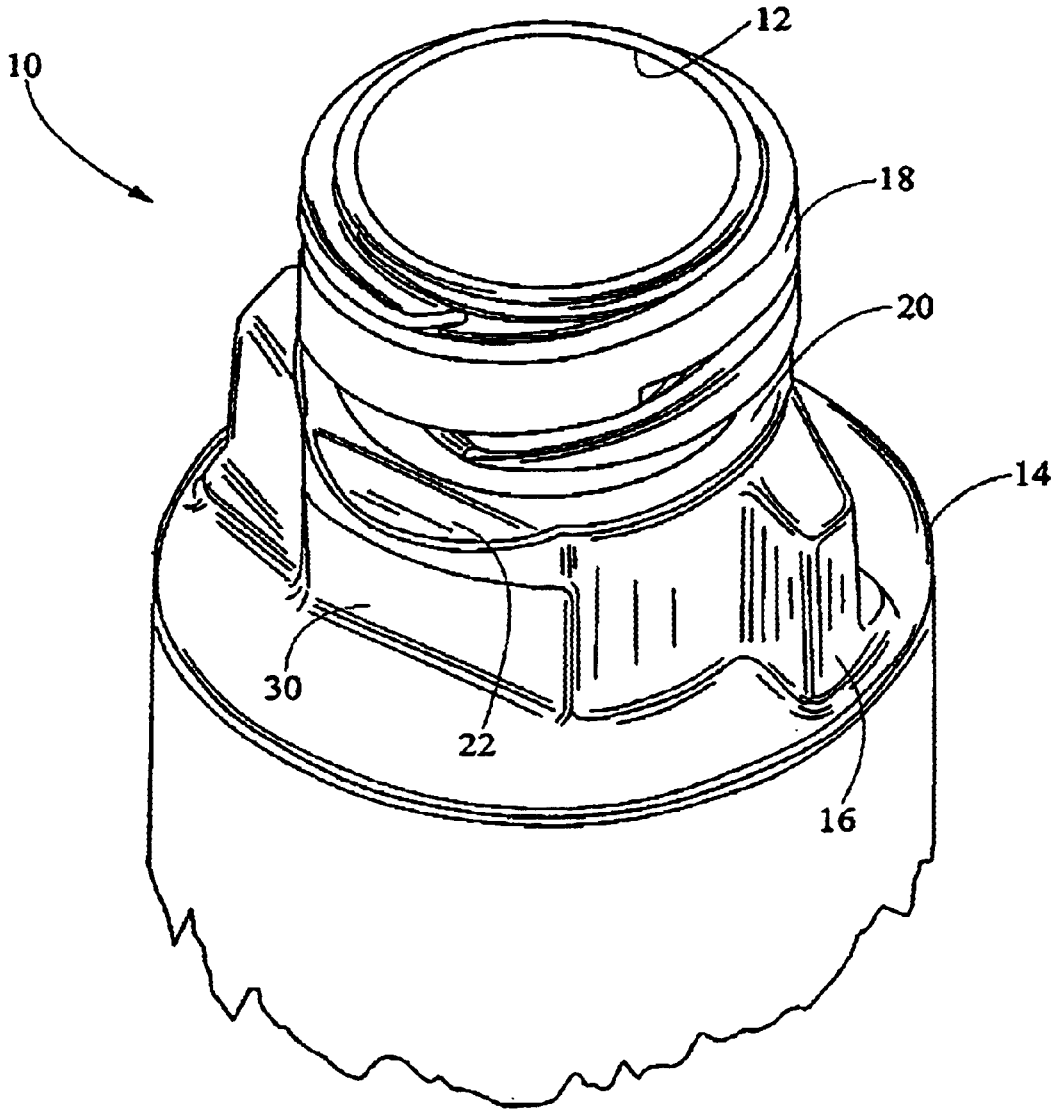
FIG. 1 is a perspective view of an embodiment of a bottle having a neck made in accordance with the present invention.
Figure 2:
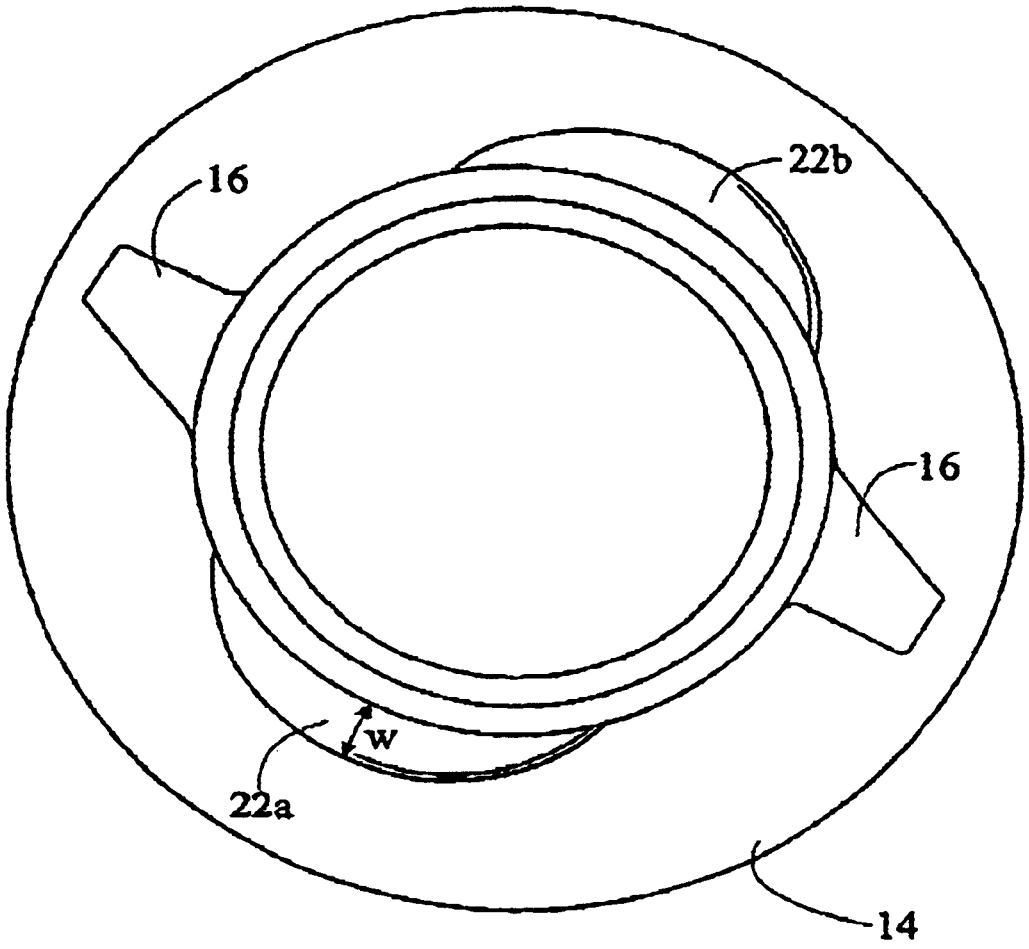
FIG. 2 is a top view of the bottle neck on the bottle of FIG. 1.

Reference is first made to FIGS. 1 and 2 in which a bottle neck constructed in accordance with the present invention is generally noted by the character numeral 10. The bottle neck 10 has an open end 12 and a shoulder 14. At least one thread 18 is positioned near the open end 12 and at least one locking lug 16 is positioned near the shoulder 14. The neck 10 further includes at least one anti-removal ring 20 which is positioned between the lug 16 and the open end of the neck 12 and encircles the neck 10. The ring 20 is adapted to impede the removal of the child-resistant closure by including at least one flange, brim, extension, latch, hook or similar projection 22 which projects from the ring 20 away from the neck 10. For example, as shown in FIGS. 1 and 2, the ring 20 can include a first and a second brim 22*a*, 22*b*, with the first brim 22*a* being radially offset from the second brim 22*b* by about 180°. The brims 22*a*, 22*b* are essentially identical and each has a slightly ovoid shape with a maximum width "w". The width "w" should be sufficient to prevent the user from disengaging the bottle lugs 16 from the corresponding closure lugs when the closure 50 is axially displaced from the shoulder 14 by more than one full rotation and the closure skirt 54 is deformed.

When the closure 50 is open, the anti-removal ring 20 on the bottle neck 10 functions to deter the user from deforming the closure skirt 54 to a sufficient extent that the closure locking hip can completely disengage from the bottle locking tags 16 thereby allowing the closure 50 to be removed from the bottle. Specifically, when the closure 50 is in the open position, the closure locking lugs abut the anti-removal ring projection 22 and the bottle lugs 16. If the user attempts to squeeze the closure skirt 54 to disengage the closure lugs from the bottle lugs 16, the projection 22 on the ring 20 creates a barrier that prevents the user from deforming the closure skirt to the extent required to disengage the lugs 16.

Figure 3:
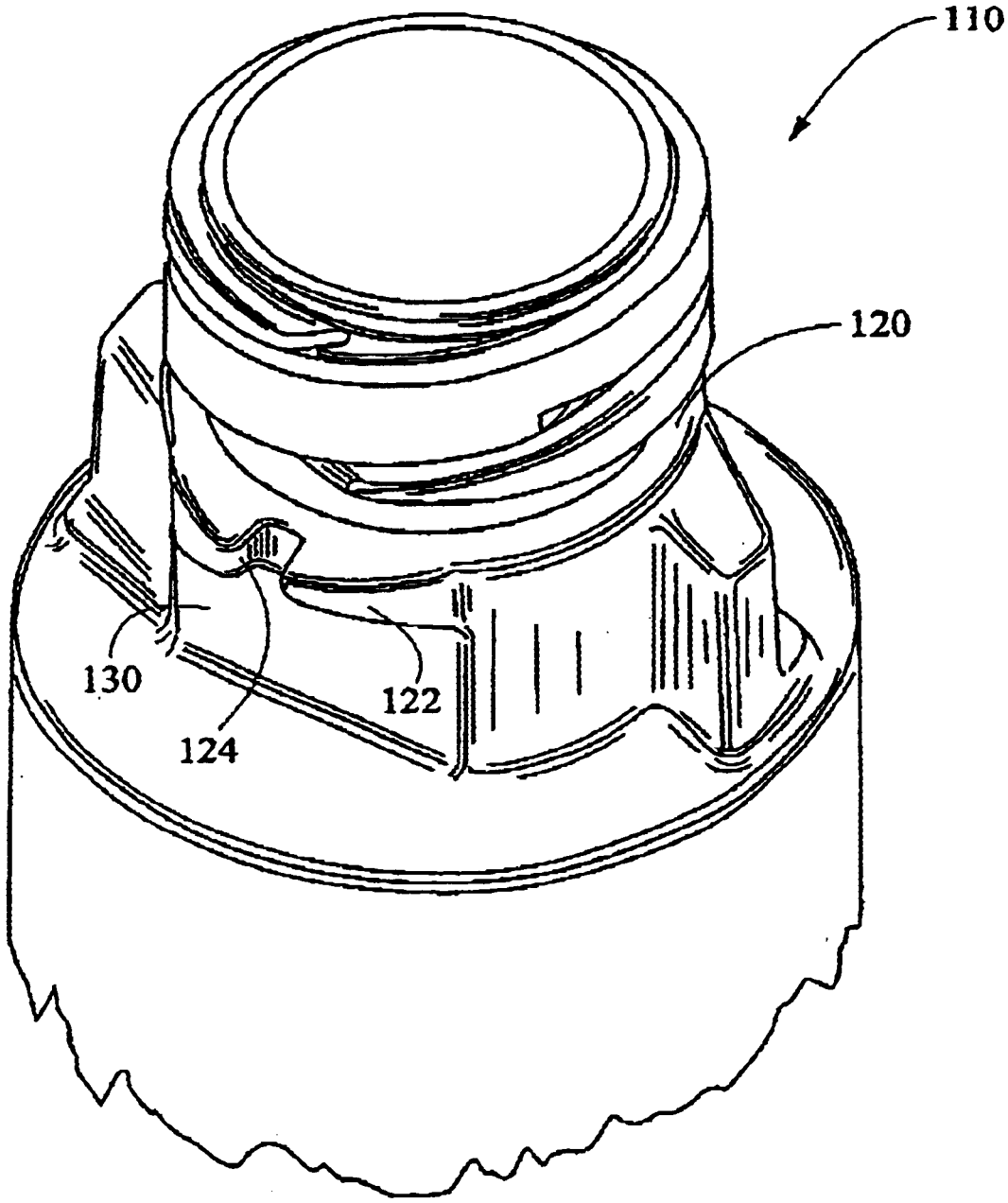
FIG. 3 is a perspective view of a first alternative embodiment of a bottle having a neck made in accordance with the present invention.

A first alternative embodiment 110 is shown in FIG. 3. The bottle neck 110 has an anti-removal ring 120 which further includes a notch 124 on a brim 122. The notch 124 is adapted to retain the closure locking lug. After the closure locking lugs are initially released from the bottle locking lugs 16, further squeezing of the closure 50 causes the closure locking lug to be held in the notch 124, thereby preventing further rotation and removal of the closure 50.

Figure 4:
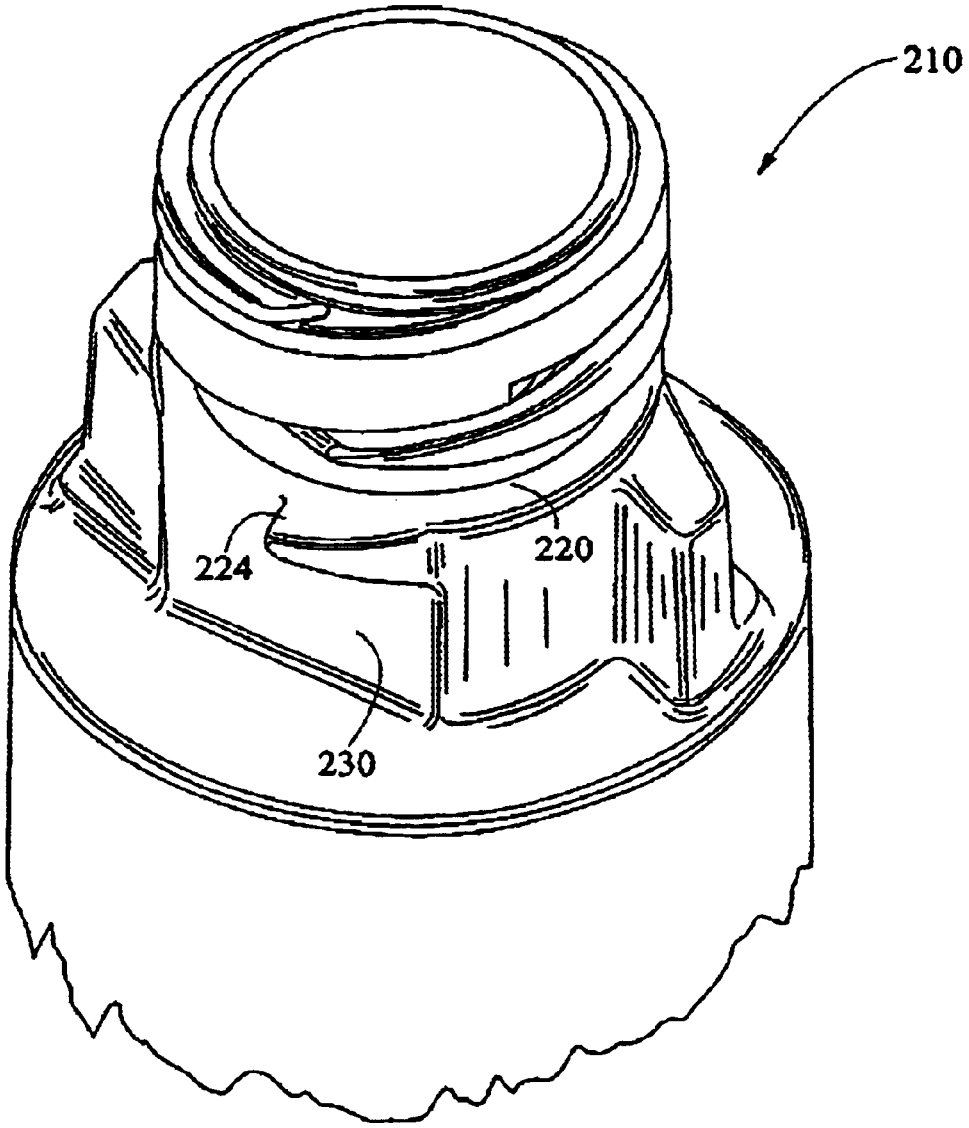
FIG. 4 is a perspective view of a second alternative embodiment of a bottle having a neck made in accordance with the present invention.

A second alternative embodiment 210 is shown in FIG. 4. The bottle neck 210 has an anti-removal ring 220 which further includes a flange or partial segment of a brim 224. The flange 224 is flared outward from the bottle neck 210. After the closure locking lugs are initially released from the bottle locking lugs 16, further squeezing of the closure 50 causes the closure locking lug to engage the flange 224, thereby preventing further rotation and removal of the closure 50.

The anti-removal ring 20, and particularly the projection 22, can make it more difficult for the user to squeeze and deform the closure skirt 54 to initially disengage the closure locking lugs from the bottle locking lugs 16 and open the bottle. To overcome this problem, the bottle neck 10 may include at least one deformation recess 30, shown in FIG. 1. The recess 30 is a region between the projection 22 and the shoulder 14 which is indented or recessed relative to the projection 22. The recess 30 allows the user to apply greater pressure to the closure skirt 54 in the recessed region 30 than can be applied in a non-recessed region. This causes greater deformation to the skirt 54—the skirt 54 can have a pronounced oblong shape—and allows the closure lugs to flare out farther than could be achieved without the recess 30, thereby allowing the closure lugs to separate from the bottle lugs 16. As shown in FIGS. 3 and 4, essentially identical deformation recesses 130, 230 may be included with the alternative embodiment anti-removal rings 120, 220, respectively.

From a reading of the above, one with ordinary skill in the art should be able to devise variations to the inventive features. For example, the notch on the projection may have different shapes or configurations adapted to match the locking lugs on the intended closure. These and other variations are believed to fall within the spirit and scope of the attached claims.

What is claimed is:

1. A bottle neck having an anti-removal feature, comprising:

a bottle shoulder;

a neck extending upwardly from said shoulder and having an open end and at least one thread helically extending around said neck;

at least one locking lug positioned near said bottle shoulder;

at least first and second ovoid brims extending outward from opposed sides of said neck; and, at least one recess disposed beneath and inwardly of each of said at least first and second brims;

said at least one recess is a flat planar recess formed on said neck.

2. The bottle neck of claim 1 wherein said first and second brims are spaced equidistantly apart from a first and a second locking lug formed near said bottle shoulder.

3. The bottle neck of claim 1, said at least one recess being a first and a second recess formed respectively below said first and second brims, each of said first and second recess being a flat planar surface on said neck.

4. The neck having an anti-removal feature of claim 1 wherein said at least first and second brims have a notch centrally formed therein.

5. The bottle neck of claim 1, said at least one recess being two substantially diametrically opposed recesses.

6. A bottle neck which impedes the removal of a closure, comprising:

a bottle having a shoulder and an upstanding neck, said neck having an open end and at least one thread formed on the exterior of said neck;

at least one locking lag projection formed on said shoulder;

at least a first and a second ovoid deformation prevention projections in opposing relationship on said bottle neck radially offset from each other by 180 degrees; and, opposing first and second recesses formed on said neck below and radially inwardly from said first and second deformation prevention projections;

wherein said first and second recesses are planar recesses formed on said neck.

7. A bottle neck which impedes the removal of a closure, comprising:

a bottle having a shoulder and an upstanding neck, said neck having an open end and at least one dread formed on the exterior of said neck;

at least one locking lug projection formed on said shoulder;

at least first and second outwardly extending ovoid deformation prevention projections;

at least one recess formed below and radially inwardly from said at least first and second deformation prevention projections;

wherein said projections prevents inward deformation of a closure side wall adjacent said projection;

wherein at least one recess is a flat planar surface formed on said neck.

8. The bottle neck of claim 7 wherein said at least first and second deformation prevention projections are in opposing relationship on said neck.

9. The bottle neck of claim 8 wherein said first and second projections are each radially offset from each other by about 180 degrees.

10. A bottle neck and child resistant closure combination, comprising:

a closure having a top wall and a depending side wall, an aperture formed in said top wall;

a bottle having a shoulder and an upstanding neck terminating at an opening, said neck having a thread formed thereon for receiving said closure and a first and a second container locking lug;

a first and a second outwardly extending ovoid deformation prevention projections on said neck below said thread;

at least one recess positioned beneath and radially inward from each of said first and second deformation prevention projections;

wherein said at least one recess is a first and second planar surface formed on said neck;

wherein said first and said second outwardly extending deformation prevention projections prevent the inward deformation of said side wall of said closure.

11. The bottle neck of and closure combination of claim 10 wherein said first and second deformation prevention projections have a notch.

12. A bottle neck and child resistant closure combination, comprising:

a closure having a top wall and a depending side wall, an aperture formed in said top wail;

a bottle having a shoulder and upstanding neck terminating at an opening, said neck having a thread formed thereon for receiving said closure and a first and a second container locking lug;

a first and a second outwardly extending ovoid flanges on said neck below said thread to prevent continued rotation of said closure after partial removal of said closure from said bottle neck; and, at least one recess positioned beneath and inwardly from each of said first and second outwardly extending flanges;

said at least one recess being a planar surface formed on said upstanding neck.

13. The bottle neck of claim 12, said at least one recess being a first and second deformation recesses adjacent said first and second flange.

* * * * *